US005752762A

United States Patent [19]

Chen

[11] Patent Number: 5,752,762

[45] Date of Patent: May 19, 1998

[54] FLASHLIGHT

[76] Inventor: Chin-Hsiang Chen, No. 32 Lane398, Fu Chiang Rd. Sec2, Yung Kang Hsiang, Tainan Hsiang, Taiwan

[21] Appl. No.: 600,099

[22] Filed: Feb. 8, 1996

[51] Int. Cl.[6] ..... F21L 7/00

[52] U.S. Cl. ..... 362/202; 362/205; 362/208

[58] Field of Search ..... 362/202, 203, 362/205, 208, 190, 191, 281

[56] References Cited

U.S. PATENT DOCUMENTS 4,744,013 5/1988 Lee et al. ..... 362/202

4,881,158 11/1989 Price, III ..... 362/205

*Primary Examiner*—Y My Quach

*Attorney, Agent, or Firm*—Pro-Techtor International

[57] ABSTRACT

A flashlight usable as an extensible signal bar includes a casing, a switch housing containing a push button connected with a T-shaped conductor elastically urged by a double conical spring housed in a short tube, a lamp holder located in front of the switch housing in the casing, a lamp housing protecting a lamp and a reflector in a rear portion and having a front hollow portion for combining an extensible signal bar. The extensible signal bar consists of a plurality of sleeves, which can be collapsed within the lamp housing or extended out thereof to form a fully extended signal bar to function as a warning means if needed.

4 Claims, 4 Drawing Sheets

FLASHLIGHT

BACKGROUND OF THE INVENTION

This invention concerns a flashlight usable as an extensible signal bar, particularly having the extensible signal bar consisting of plural sleeves combined in a lamp housing in a collapsed condition and able to be telescopically extended out thereof to become a long signal bar used as a warning means.

Most common traditional flashlights generally have a switch to be pushed back and forth to move a lamp holder back and forth at the same time to turn on or off electricity. This kind of structure has been found to get electric connection easily out of order, and almost are not manufactured or used.

At present, known flashlights having a push button or a rotatable button is used for turning on or off electricity and a lamp housing is used to adjust the distance of the focus point of a lens. A U.S. Patent of the Ser. No. 4,286,311 "FLASHLIGHT" is among one of them. However, this flashlight has a complicated structure combined with many components for assembling, costing very expensive.

A common night signal bar is made to have a definite length, unable to be collapsed to a short length, so it is not so convenient to be carried by guards, police, etc.

SUMMARY OF THE INVENTION

An object of this invention is to offer a flashlight combined with an extensible signal bar.

A flashlight usable as an extensible signal bar in the present invention includes a casing for containing a switch housing and two or more batteries, a lamp housing combined with a front portion of the casing, a lamp holder fixed in the casing in front of the switch housing, and an end cap combined with a rear end of the casing. The switch housing has a front tubular socket for a T-shaped conductor to fit in, a double conical spring elastically urging rearward the conductor to connect with a push button with wire, a short tube housing the double conical spring. The lamp holder has four slots to engage with four projecting radially walls of the tubular socket of the switch housing, located in front of the switch housing in the casing. After a lamp screws with the lamp holder, the bottom contact of a lamp fits in a hole of the short tube, contacting with a front end of the double conical spring. A conical spring is provided to be clamped between the end cap and the rearmost battery so as to elastically urging the batteries always electrically connected with one another. Then the negative is connected with the end cap, the casing, the lamp holder, and the positive can be connected with a push button when depressed, the T-shaped conductor, the double conical spring and the bottom contact of the lamp. So the push button can turn on or off electricity of the lamp coming from the batteries.

The extensible signal bar is combined in the front inner portion of the lamp housing, consisting of a foremost sleeve, plural intermediate sleeves and a rearmost sleeve combined together in a telescopic way, located within the lamp housing in a collapsed condition and able to be extended out of the lamp housing, to function as a signal bar.

BRIEF DESCRIPTION OF DRAWINGS

This invention will be better understood by reference to the accompanying drawings, wherein.

DESCRIPTION OF THE PREFERRED EMBODIMENT

Figure 1:
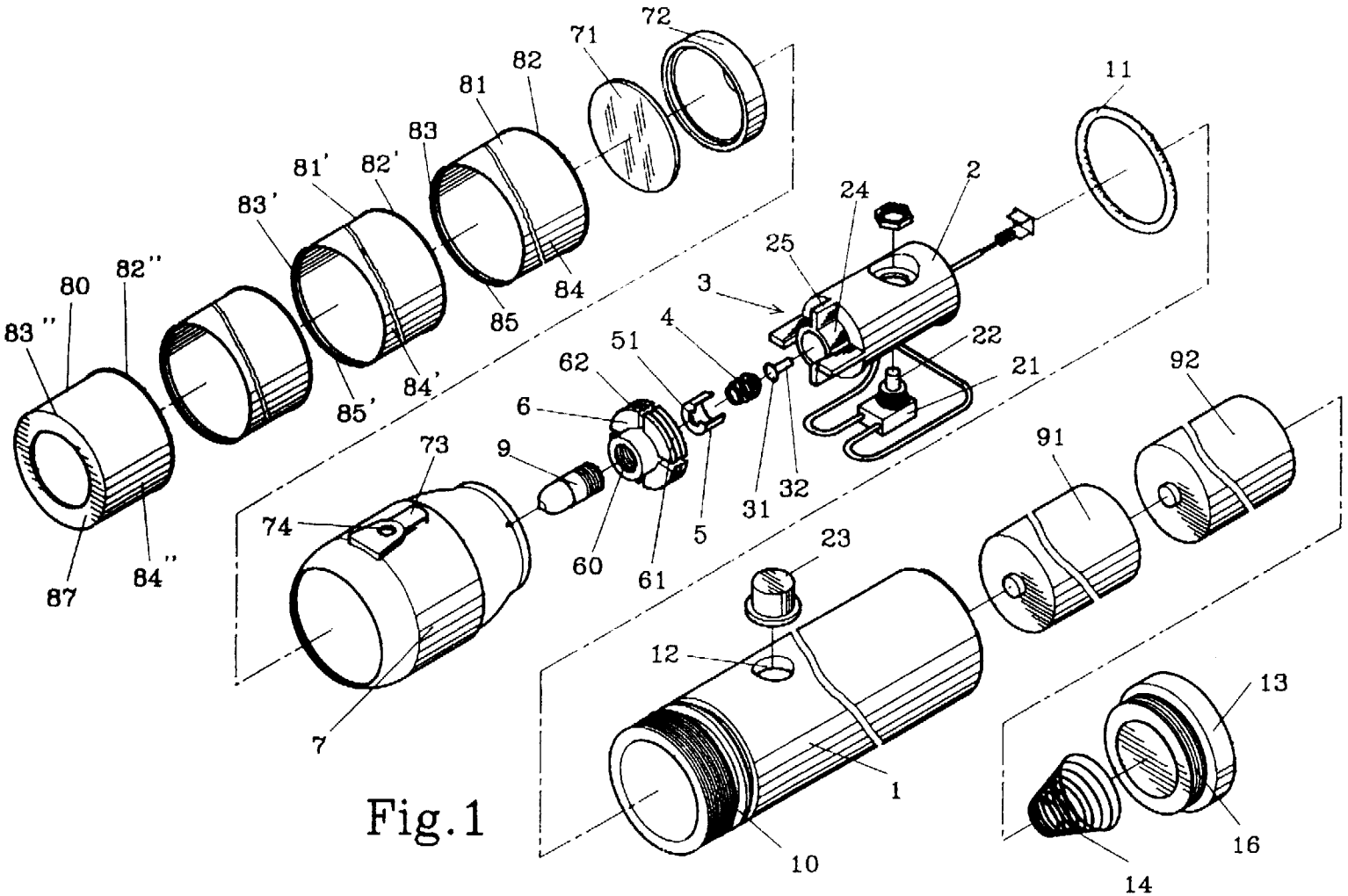
FIG. 1 is an exploded perspective view of a flashlight in the present invention.

A preferred embodiment of a flashlight usable as an extensible signal bar in the present invention, as shown in FIG. 1, includes a cylindrical casing 1, a lamp housing 7 combined with the front end of the casing 1, a tail cap 13 combined with the rear end of the casing 1, a switch housing 2 contained in the casing 1, and a lamp holder 6 fixed in a front inner portion of the casing 1 and in front of the switch housing 2, and an extensible signal bar 8 extensibly combined in the lamp housing 7, as main components combined together.

The cylindrical casing 1 has a proper length for containing the lamp housing 2 and two or more batteries 91, 92, and having a front male thread 10 engaging with a female thread 70 of the lamp housing 7, and an annular groove behind the male thread 10 for an O-ring 11 to engage therein, and a female thread 15 in a rear end for a male thread 16 of the end cap 13 to engage. The casing 1 further has a button hole 12 in the periphery wall near behind the lamp housing 7 for fitting therein a post 22 and a cap 23 of a push button 21 of the switch housing 2, with the cap 23 overlying the post 22.

Figure 2:
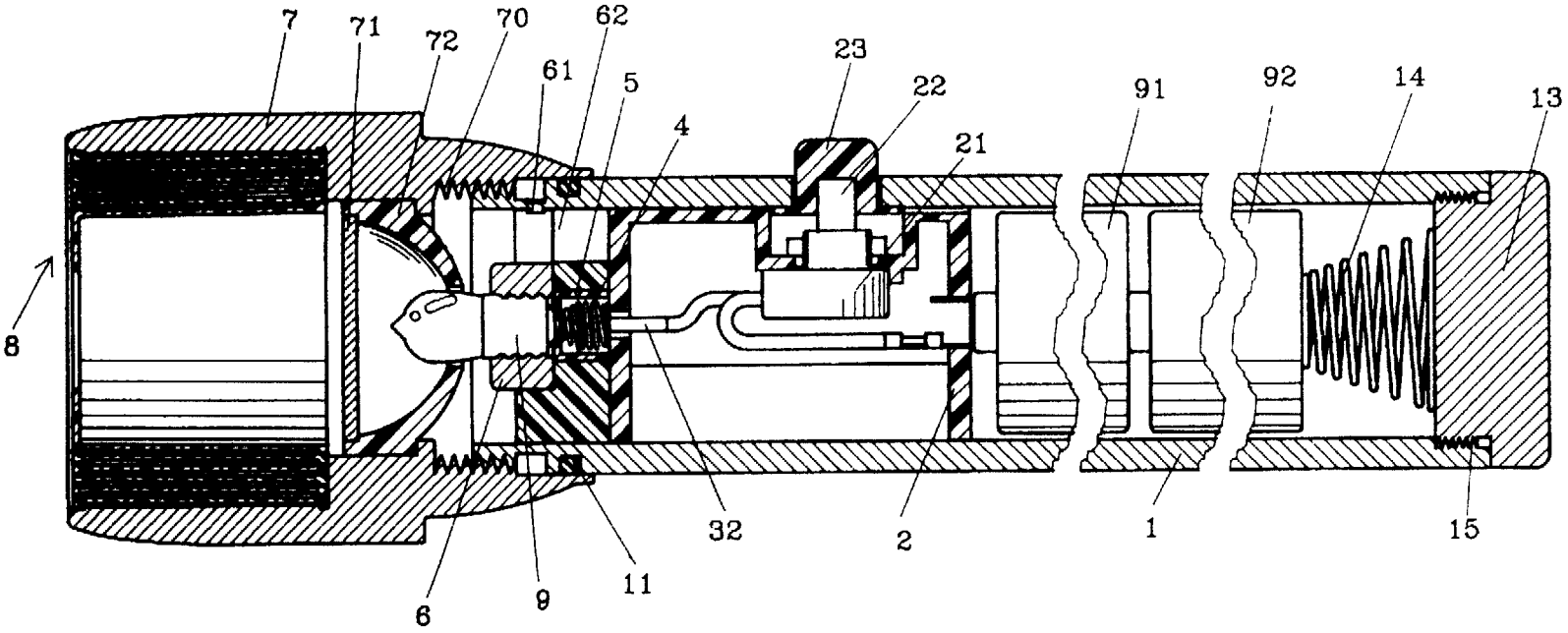
FIG. 2 is a cross-sectional view of the flashlight in the present invention.

The switch housing 2, as shown in FIGS. 1 and 2, is made of an insulating material having high dielectric quality, having a front tubular socket 24 formed in a front portion and provided with four position walls 25 extending out radially from the socket 24. The four position walls 25 fit in four slots 62 of the lamp holder 6 to secure the lamp holder 6 in place.

A T-shaped conductor 3 is provided, as shown in FIGS. 1 and 2, made of a metal, having a disc head 31 abutting on the rear end of a double conical spring 4 and a small round post 32 extending down from the head 31 and inserting in the front tubular socket 24 to be electrically connected with the push button switch 21 with wire.

A double conical spring 4 made of metal is provided, having a rear end elastically urging the head 31 of the conductor 3 and a front end being in urging contact with a bottom contact of a lamp 9 held in the lamp holder 6.

A short tube 5 of deelectric quality is provided, having a contact hole 51 in a front side wall for a positive bottom contact of the lamp 9 to be located therein and being urged by the double conical spring 4, which is also prevented from disfiguring by means of the short tube 5.

The lamp holder 6 is made of a metal, combined with the front tubular socket 24 of the switch housing 2, having an annular groove 61 in an outer periphery so that the lamp holder 6 may be firmly secured in the casing 1, with projections on an inner surface of the casing 1 engaging with the annular groove 61. The lamp holder 6 has a female-threaded hole 60 for a male-threaded end of a lamp 9 to screw with, and four slots 62 diametrically spaced apart equidistantly to engage the four position walls 25 of the front tubular socket 24 so as to secure the socket 24 in place.

The lamp housing 7 is shaped as cylindrical with an intermediate portion swelled up a little, having a female thread 70 in a rear portion to engage with the front male thread of the casing 1, a rear end annular groove 75 and a front end annular groove 76 in a front large diameter hollow portion, in which the extensible signal bar 8 is positioned. Then when the extensible signal bar 8' moves back to the collapsed condition in the lamp housing 7, a rear end flange 82 of a sleeve 81 engages with the rear end annular groove 75 to secured the collapsed signal bar 8, and engages with the front end annular groove 76 to secure the extended signal bar 8. The lamp housing 7 further has a lens 71 fixed just behind the extensible signal bar 8 and a parabolic reflector 72 located at an inner intermediate surface thereof.

The tail cap 13 has a front female thread 16 to engage a rear male thread of the casing, receiving a conical compressing spring 14 with a front end surface so that the conical compressing spring 14 may elastically urge the bottom of the rearmost battery 92, keeping all the batteries 91, 92 always electrically connected with each other.

Figure 4:
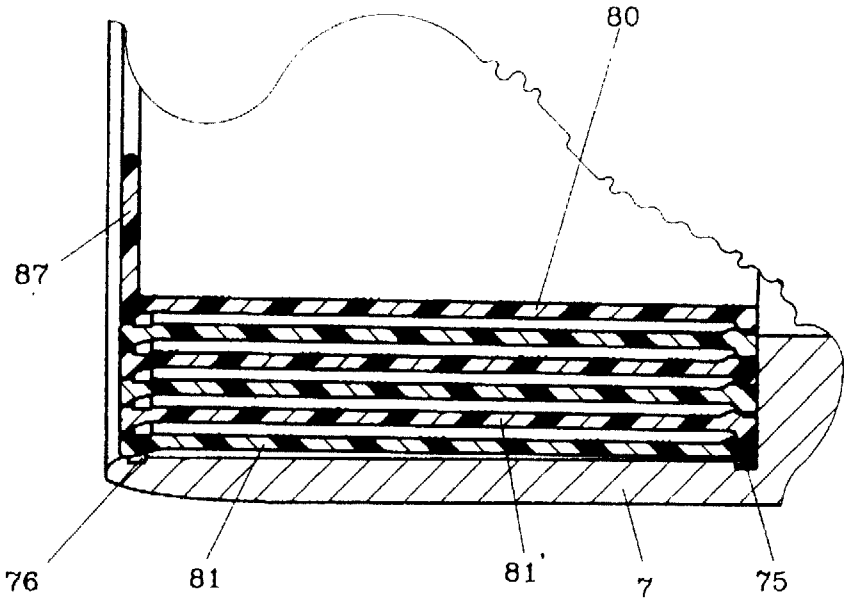
FIG. 4 is a side cross-sectional view of sleeves of an extensible signal bar in the flashlight in the present invention, showing the sleeves in the collapsed position.
Figure 3:
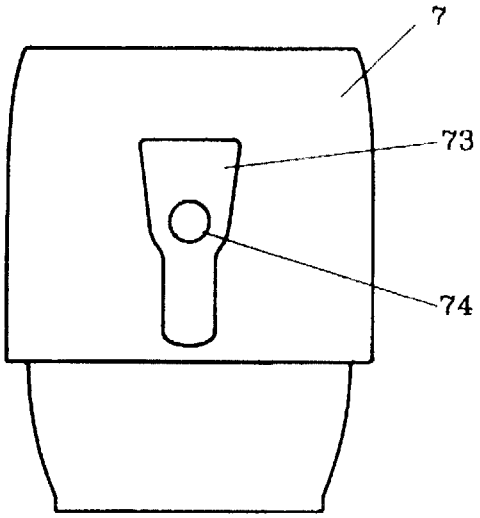
FIG. 3 is an upper view of a lamp housing in the flashlight in the present invention.
Figure 5:
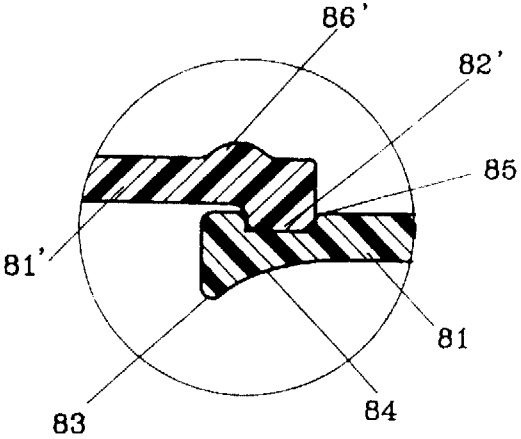
FIG. 5 is a cross-sectional view of two sleeves of the extensible signal bar in the flashlight in the present invention, showing the sleeves in the secured extended position.
Figure 6:
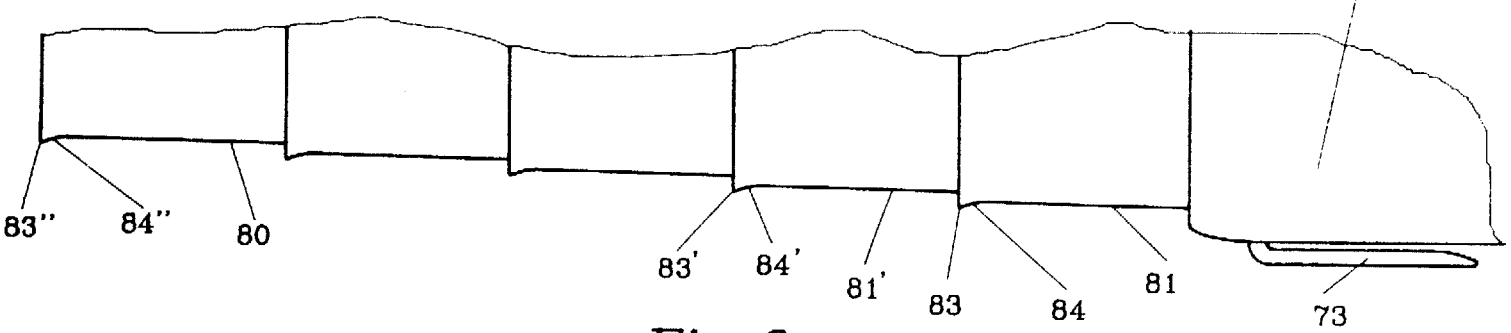
FIG. 6 is a side view of the extensible signal bar of the flashlight in the present invention, showing it in an extended condition.

The extensible signal bar 8, as shown in FIGS. 4, 5 and 6, consists of a foremost sleeves 80, a plurality of intermediate sleeves 81', for example three as illustrated in FIG. 6, and a rearmost sleeve 81, telescopically combined extensible from one another. The foremost sleeves 80, the intermediate sleeves 81' and the rearmost sleeve 81 respectively have diameters a little larger than the front one in order so that they can be fitted in one another for telescopically collapsing into the lamp housing 2 or extended out thereof. The plural intermediate sleeves 81' and the foremost sleeve 80 respectively have a rear end flange 82, 82', 82" and a front end flange 83, 83', 83". The front end flanges 83, 83', 83" each has a curved-down surface 84, 84', 84" extending down rearward from each flange. Further, the rearmost sleeve 81 and the intermediate sleeves 81' each has a front annular groove 85, 85' in the inner surface and a rear curved-up annular projection 86, 86'. The foremost sleeve 80 has a front end inner annular projection 87.

After the extensible signal bar 8 is combined telescopically as described above in the front inner portion of the lamp housing 2 and is to be telescoped out of the collapsed position in the lamp housing 2, the front end inner annular projection 87 of the foremost sleevs 80 can be caught by a finger for pulling out in order first, then the first intermediate sleeve 81', the second and the third intermediate sleeve 81', and lastly the rearmost sleeve 81, with the flange 82 of the rearmost sleeve 81 engaging with the front annular groove 76 of the lamp housing 7, with the flange 82' of the third intermediate sleeve 81' engaging the annular groove 85 of the rearmost sleeve, and so on. Then the extensible signal bar 8 is completely extended in full length and kept secured in that position.

Provided the extensible signal bar 8 is to be collapsed from the extended condition into the collapsed condition in the lamp housing 2, the foremost sleeve 80 is forcibly pushed rearward to disengage the rear flange 82 from the annular groove 85' of the first intermediate sleeve 81' until the front end of the foremost sleeve 80 reachs the front end of the first intermediate sleeve 81', with the curved-down surface 84 of the foremost sleeve 80 stopped by the flange 83' of the first intermediate sleeve 81'. Then the first intermediate sleeve 81' together with the foremost sleeve 80 are pushed forcibly rearward to disengage the flange 82' of the first intermediate flange 81' from the annular groove 85' of the second intermediate sleeve 81' until the front end of the foremost sleeve 80 and of the first intermediate sleeve 81' reach the front end of the second intermediate sleeve 81'. Then the foremost sleeve 80, the first and the second intermediate sleeve 81' are pushed back in the rearmost sleeve 81 in the same way, and finally the rearmost sleeve 81 with the other sleeve 80, 81' are all pushed within the lamp housing 2, with the flange 82' of the third intermediate sleeve 81' stopped by curved-up projection 86 of the rearmost sleeve 81, and the curved-down surface 84' stopped by the flange 83 of the rearmost sleeve 81. Then all the sleeves are all collapsed within the lamp housing 2.

While the preferred embodiment of the invention has been described above, it will be recognized and understood that various modifications may be made therein and the appended claims are intended to cover all such modifications which may fall within the spirit and scope of the invention.

What is claimed is:

1. A flashlight comprising:

a cylindrical casing contains a switch assembly and a plurality of batteries, a male thread on a front end of said casing mates with a female thread on a lamp housing, a button hole situated in an intermediate wall of said casing receives a push button switch of said switch housing, and a rear female thread of said casing mates with a male thread of a tail cap;

said switch assembly having a non-conductive switch housing contained in a front portion of said casing, said switch housing has a front tubular socket and four walls spaced radially around said tubular socket, the switch housing further includes a T-shaped metal conductor with a disc head and a small round post, said head contacts a rear end of a double conical spring, said round post is received in said tubular socket and electrically connected with said push button switch, said double conical spring housed in a short tube also contacts a positive bottom contact of a lamp screwed into a lamp holder, said short tube has a contact hole in a front end thereof receiving said bottom contact;

said lamp holder is made of a metal, and is fixed in the front portion of said casing in front of said switch assembly, and has a female threaded hole receiving said lamp, said lamp holder further includes four slots in an annular wall of said lamp holder, said four slots engaging said four walls of said tubular socket of said switch housing;

said lamp housing is cylindrical having a regular portion, an enlarged intermediate portion, a hanger on a front outer surface of said lamp housing and a front hollow portion containing an extensible signal bar, a front annular groove in a front end of said front hollow portion and a rear annular groove in a rear end of said front hollow portion, said front annular groove and said rear annular groove engage a front flange of a rearmost sleeve of said extensible signal bar and a rear flange of said rearmost sleeve of said extensible signal bar respectively when said signal bar is collapsed and said front annular groove engages rear flange of said rearmost sleeve when said signal bar is extended; and said signal bar further comprises a foremost sleeve, a plurality of intermediate sleeves, and said rearmost sleeve, said foremost, intermediate and rearmost sleeves slidably nested within each other.

2. The flashlight as claimed in claim 1 wherein:

said foremost sleeve and each of said plurality of intermediate sleeves have a rear end flange on an outer surface and, said rearmost sleeve and each of said intermediate sleeves have a front annular groove in an inner surface so that each of said sleeves may be secured with a next sleeve in an extended position when said bar is extended, with said rear end flange of a first intermediate sleeve engaging a corresponding front annular groove of a next intermediate sleeve, said rear flange of said rearmost sleeve engages said front annular groove of said front hollow portion.

3. The flashlight as claimed in claim 1 wherein:

each of said plurality of intermediate sleeves and said foremost sleeve has a front end flange and a curved surface extending rearward from said front end flange, and each of said plurality of intermediate sleeves has a curved projection at a rear inner end thereof, each of said curved surfaces engages and moves with a rear end of a corresponding foremost sleeve, and each said curved projection engages and moves with a front end of a corresponding rearmost sleeve.

4. The flashlight as claimed in claim 1 wherein:

said foremost sleeve of said extensible signal bar has an annular projection projected from front end surface toward said lamp so that said foremost sleeve, said plurality of intermediate sleeves, and said rearmost sleeve can be pulled out of said lamp housing through an engagement of said annular projection, said rear flange engages said front annular groove of said lamp housing to secure said signal bar in a fully extended position.

* * * * *